US007631503B2

(12) United States Patent
Stastny et al.

(10) Patent No.: US 7,631,503 B2
(45) Date of Patent: Dec. 15, 2009

(54) COMBUSTOR WITH ENHANCED COOLING ACCESS

(75) Inventors: Honza Stastny, Georgetown (CA); Jeffrey Richard Verhiel, Toronto (CA)

(73) Assignee: Pratt & Whitney Canada Corp., Longueuil (CA)

( * ) Notice: Subject to any disclaimer, the term of this patent is extended or adjusted under 35 U.S.C. 154(b) by 323 days.

(21) Appl. No.: 11/518,876

(22) Filed: Sep. 12, 2006

(65) Prior Publication Data

US 2008/0060360 A1 Mar. 13, 2008

(51) Int. Cl.
*F02C 3/00* (2006.01)

(52) U.S. Cl. ..... 60/756; 60/752; 60/796

(58) Field of Classification Search ..... 60/752, 60/756, 757, 796, 800
See application file for complete search history.

(56) References Cited

U.S. PATENT DOCUMENTS 5,253,471 A * 10/1993 Richardson ..... 60/804
5,490,389 A * 2/1996 Harrison et al. ..... 60/737
5,623,827 A * 4/1997 Monty ..... 60/748
5,956,955 A * 9/1999 Schmid ..... 60/748
6,497,105 B1 * 12/2002 Stastny ..... 60/796
6,546,733 B2 * 4/2003 North et al. ..... 60/772
2004/0250548 A1 * 12/2004 Howell et al. ..... 60/796
2008/0060360 A1 * 3/2008 Stastny et al. ..... 60/752

* cited by examiner

*Primary Examiner*—Michael Cuff
*Assistant Examiner*—Phutthiwat Wongwian
(74) *Attorney, Agent, or Firm*—Ogilvy Renault LLP

(57) ABSTRACT

A combustor for a gas turbine engine having an inner combustor wall and an outer combustor wall with a number of heat shields mounted internally thereto with fasteners. Each combustor wall has an end wall defining a combustor dome with a number of: fuel nozzle openings; impingement air openings; and heat shield fastener openings. Each of the end walls has an overlapping portion with mutually engaging sealing surfaces with the openings within the overlapping portions being aligned in overlapping pairs, where an exterior overlapping portion has at least one of the aligned openings of one overlapping pair being of larger dimension than the aligned opening in an interior overlapping portion.

6 Claims, 4 Drawing Sheets

COMBUSTOR WITH ENHANCED COOLING ACCESS

TECHNICAL FIELD

The invention relates to cooling of a gas turbine combustor cooling.

BACKGROUND OF THE ART

The invention relates to combustors for gas turbine engines assembled of an inner and an outer combustor wall with heat shields mounted internally. The combustor walls overlap at the annular dome portion of the combustor which also contains nozzle openings, impingement air cooling openings and openings to permit heat shield fasteners to pass through. The heat shield fasteners can also serve to clamp together the overlapping portions thereby sealing the overlapping surfaces.

An example of such a combustor is described in U.S. Pat. No. 6,497,105 to Stasny.

As the size of the overlapping portions increases, the likelihood of maintaining the seal increase, however interference with openings in the dome for cooling airflow and fuel nozzles increases. Since gas turbine engines and their combustors are assembled or stacked up from many interengaged parts, the compounding effect of manufacturing tolerances for each component results in a cumulative lack of accuracy for the assembled combustor. Small but allowable variations in dimensions within the tolerances set for manufacture, add up to result in a variation in the dimensions and locations of components in the assembled combustor.

Features that distinguish the present invention from the background art will be apparent from review of the disclosure, drawings and description of the invention presented below.

DISCLOSURE OF THE INVENTION

The invention provides a combustor for a gas turbine engine having an inner combustor wall and an outer combustor wall with a number of heat shields mounted internally thereto with fasteners. Each combustor wall has an end wall defining a combustor dome with a number of: fuel nozzle openings; impingement air openings; and heat shield fastener openings. Each of the end walls has an overlapping portion with mutually engaging sealing surfaces with the openings within the overlapping portions being aligned in overlapping pairs, where an exterior overlapping portion has at least one of the aligned openings of one overlapping pair being of larger dimension than the aligned opening in an interior overlapping portion.

DESCRIPTION OF THE DRAWINGS

In order that the invention may be readily understood, one embodiment of the invention is illustrated by way of example in the accompanying drawings.

Further details of the invention and its advantages will be apparent from the detailed description included below.

DETAILED DESCRIPTION OF PREFERRED EMBODIMENTS

Figure 1:
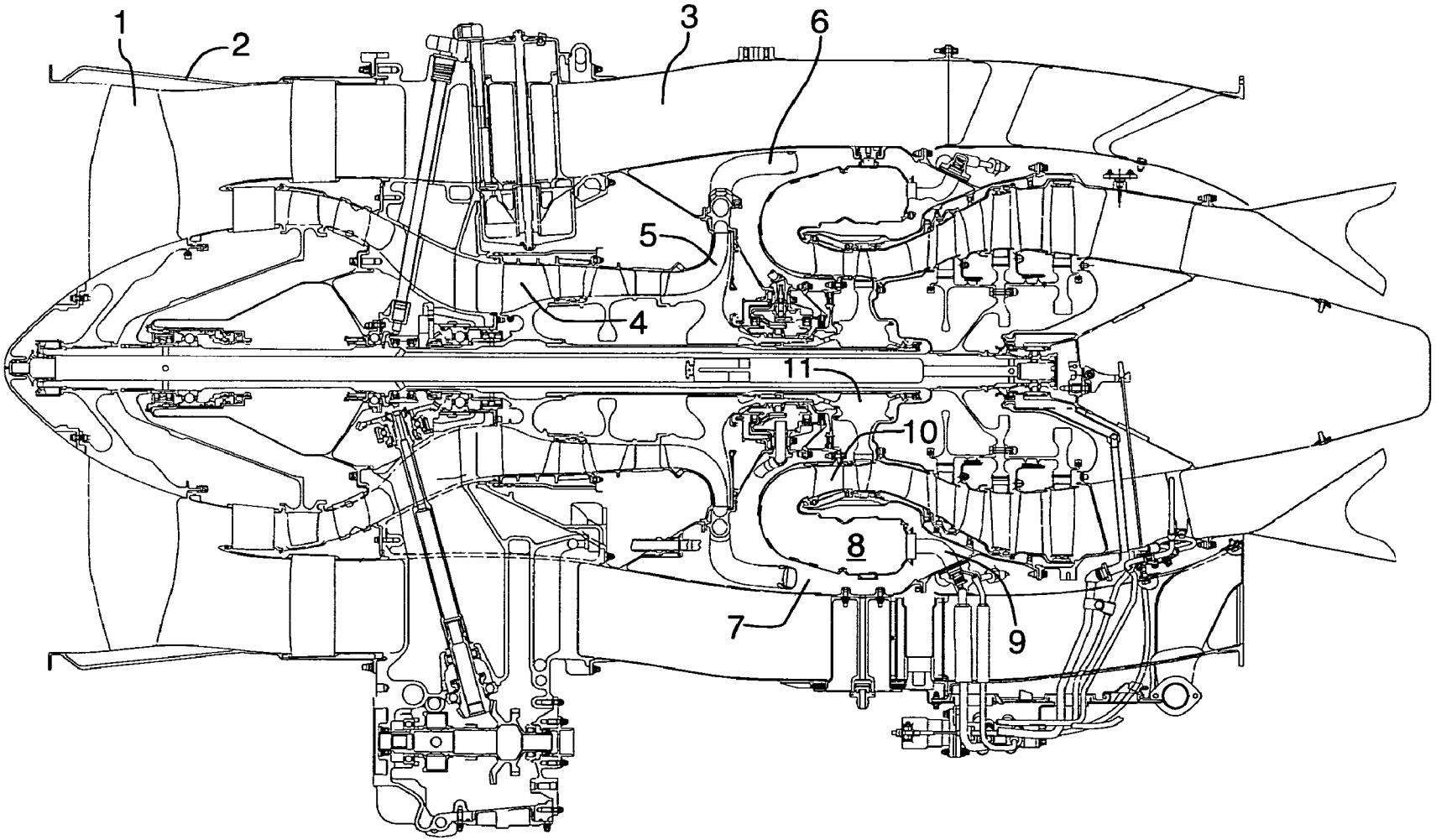
FIG.1 (Prior Art)
FIG. 1 is an axial cross-sectional view through a prior art gas turbine engine showing the various components that are assembled to produce an engine.

FIG. 1 shows an axial cross-section through a turbo-fan gas turbine engine. It will be understood however that the invention is equally applicable to any type of engine with a combustor and turbine section such as a turbo-shaft, a turbo-prop, or auxiliary power units. Air intake into the engine passes over fan blades 1 in a fan case 2 and is then split into an outer annular flow through the bypass duct 3 and an inner flow through the low-pressure axial compressor 4 and high-pressure centrifugal compressor 5. Compressed air exits the compressor 5 through a diffuser 6 and is contained within a plenum 7 that surrounds the combustor 8. Fuel is supplied to the combustor 8 through fuel tubes 9 which is mixed with air from the plenum 7 when sprayed through nozzles into the combustor 8 as a fuel air mixture that is ignited. A portion of the compressed air within the plenum 7 is admitted into the combustor 8 through orifices in the side walls to create a cooling air curtain along the combustor walls or is used for cooling to eventually mix with the hot gases from the combustor and pass over the nozzle guide vane 10 and turbines 11 before exiting the tail of the engine as exhaust.

Figure 2:
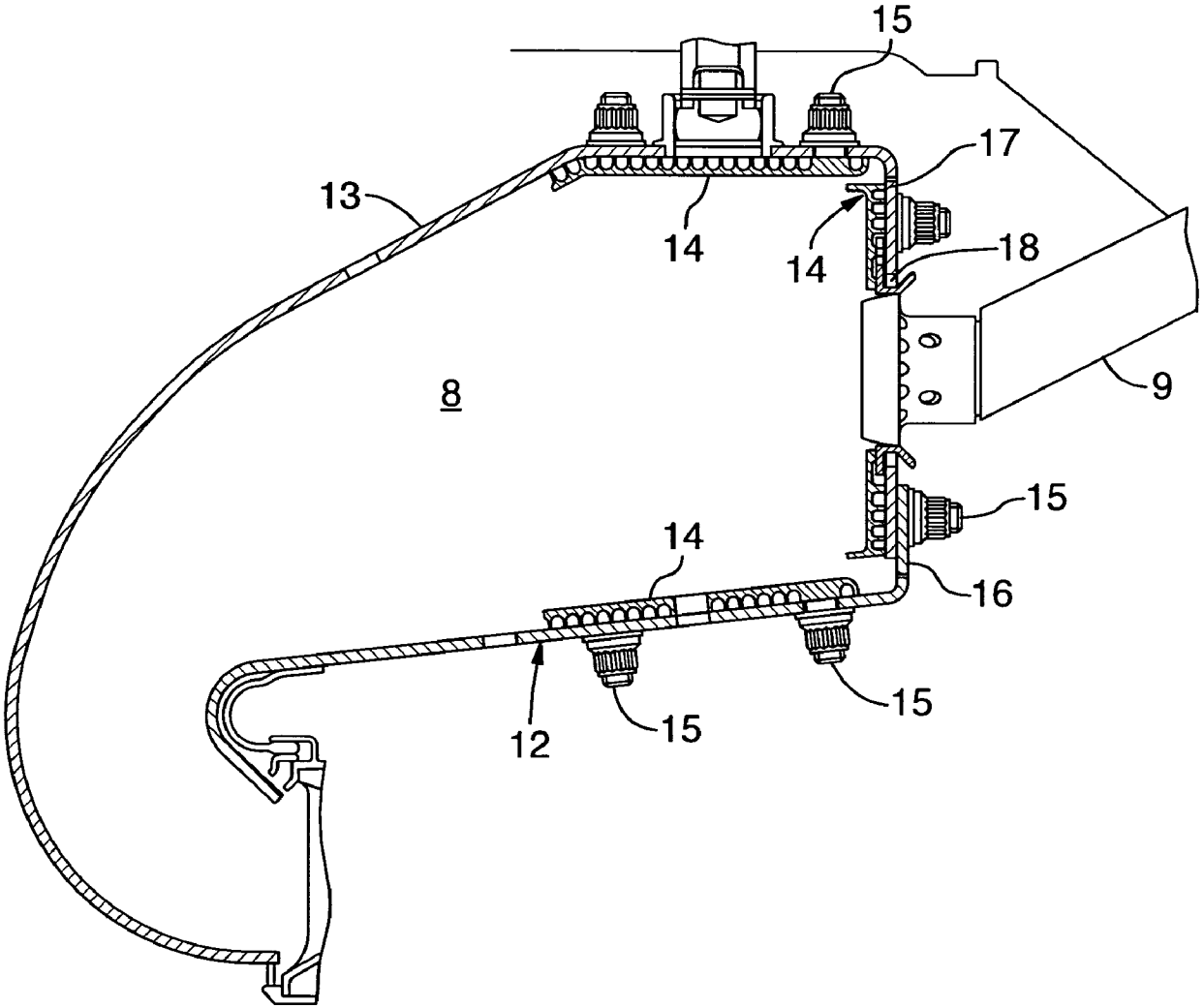
FIG. 2 is an axial cross-section through the combustor showing inner and outer combustor walls overlapping at the combustor dome, with interior heat shields mounted on threaded studs.

FIG. 2 shows a detailed axial section through a combustor 8 for a gas turbine engine having an inner combustor wall 12 and an outer combustor wall 13. A number of heat shields 14 are removably mounted on internal surfaces of the walls 12, 13 with threaded stud fasteners with self-locking nuts 15.

Figure 3:
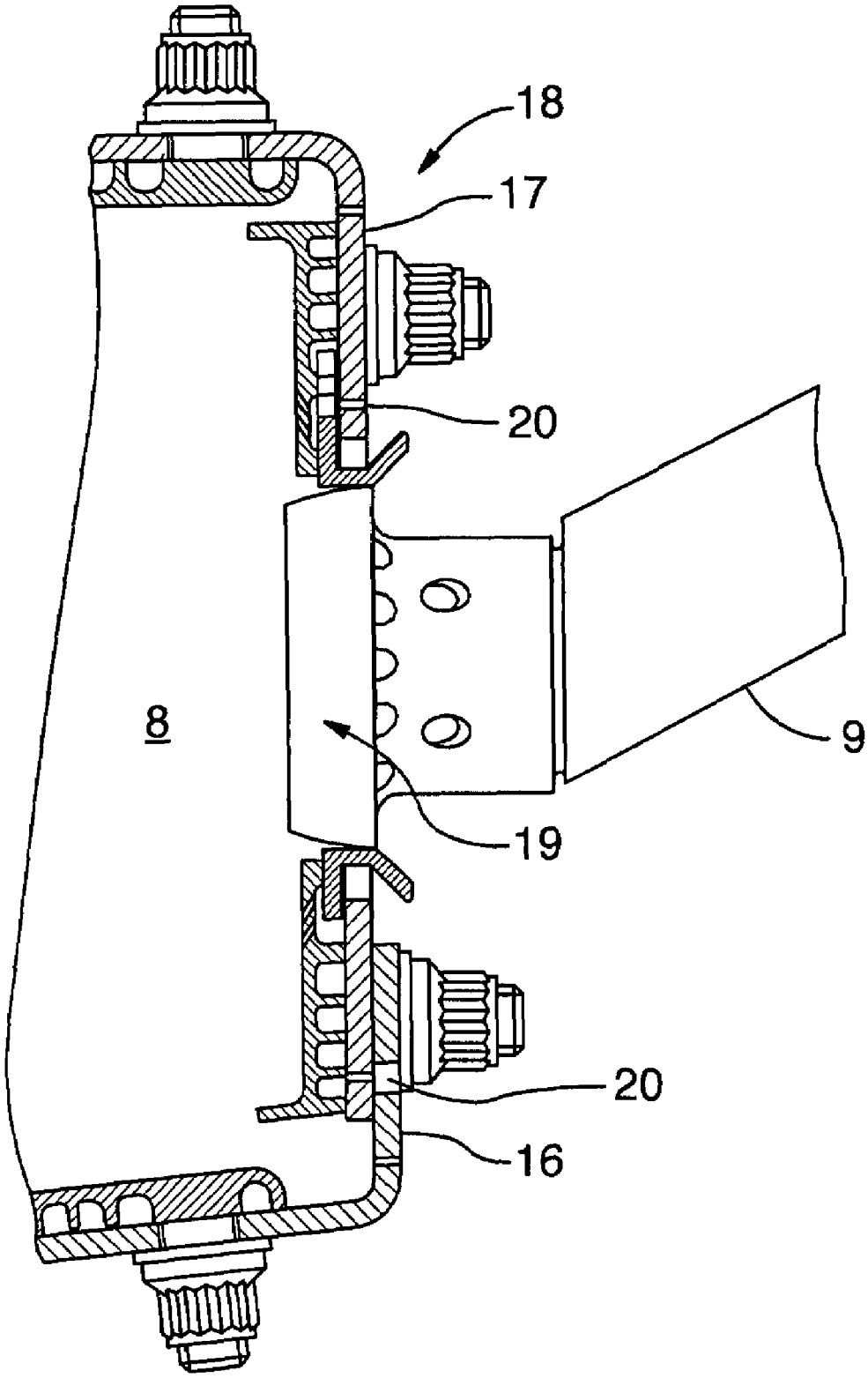
FIG. 3 is a like axial cross-section through the combustor dome.

As best seen in the detailed view of FIG. 3 each combustor wall 12, 13 has an end wall 16, 17 being a generally radial portion defining an annular combustor dome 18. The dome 18 supports fuel nozzles in a plurality of fuel nozzle openings 19 (see FIG. 4-5). The dome includes impingement air openings 20 (see FIG. 4-5) that direct cooling air from the plenum 7 into the combustor 8 to cool the underside of the heat shields 14 and then mix with combustor gases. The end walls 16, 17 making the dome 18 also include the heat shield fastener openings 21 through which the threaded studs pass and clamp the end walls 16, 17 together to seal the combustor and separate the hot gases in the combustor 8 from the compressed air in the plenum 7.

Figure 4:
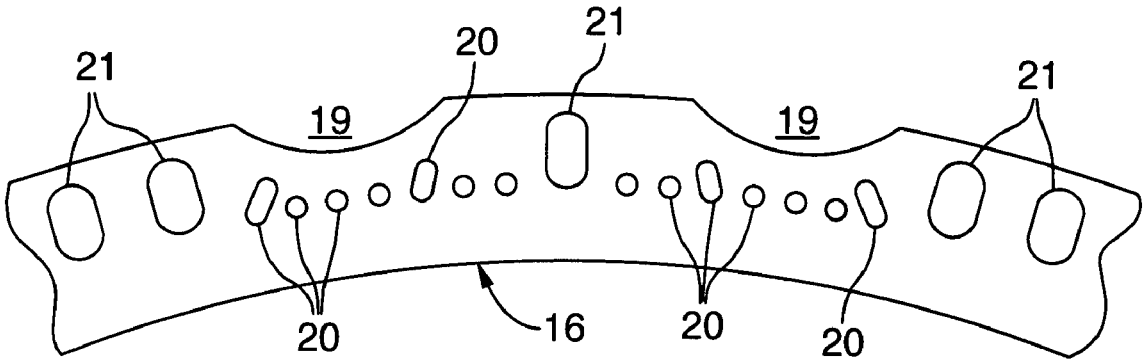
FIGS. 4 and 5 are partial radial views of the exterior and interior overlapping portions of the inner and outer combustor walls respectively, where the exterior overlapping portion of FIG. 4 shows slotted or oversized openings aligned with the openings of the interior overlapping portion of FIG. 5.
Figure 5:
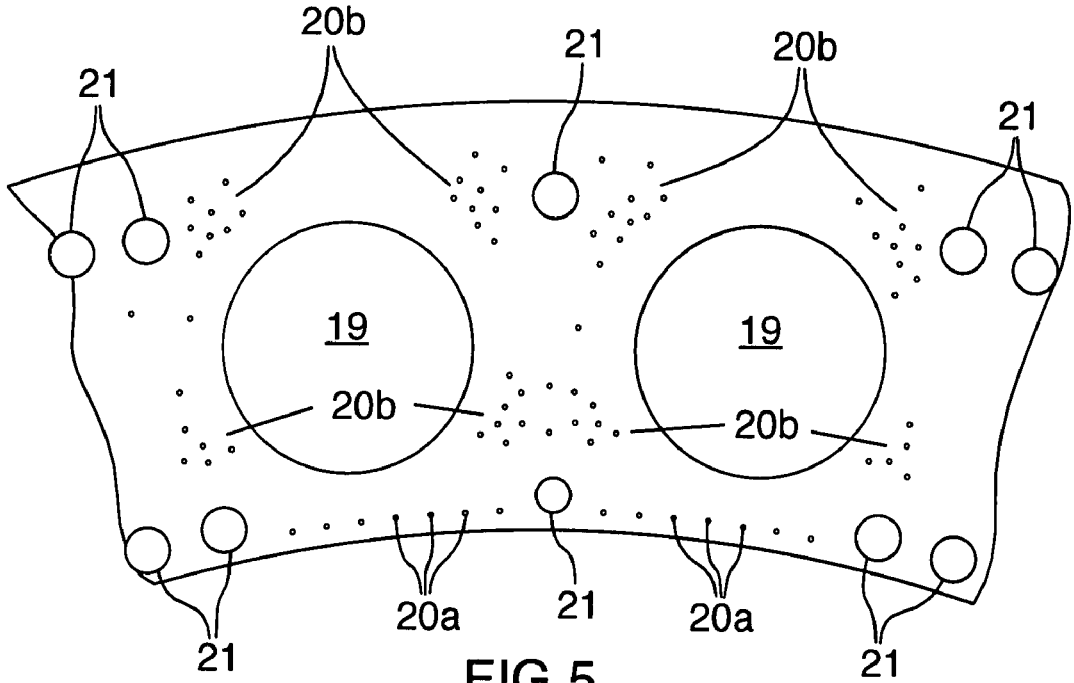

Each of the end walls 16, 17 have an overlapping portion the detailed view of which is shown in FIGS. 4-5. The overlapping portions have mutually engaging sealing surfaces with various openings 19, 20, 21 within the overlapping portions being mutually aligned in overlapping pairs. On the outer liner of FIG. 5, impingement openings 20*a* indicate those openings intended to align with corresponding openings 20 on in the inner liner of FIG. 4, while impingement openings 20*b* are merely representative of any suitable cooling hole pattern which may be used on the remainder of the outer liner. As drawn, the end wall 16 of the inner combustor wall 12 overlaps externally a portion of the end wall 17 of the outer combustor wall 13. However it will be understood that the arrangement could easily be reversed.

As shown in the example of FIG. 4, the exterior one of the overlapping portions being the end wall 16 of the inner combustor wall 12, has aligned openings 20, 21 of the overlapping pairs being of larger dimension than the aligned openings 20,

21 in the interior one of the overlapping portions, in the illustrated example being the end wall 17 of the outer combustor wall 13.

FIG. 4 shows slotted impingement air openings 20 that accommodate the accumulation of and manufacturing tolerances and alignment tolerances in assembly with the much smaller impingement air openings 20 in the underlying end wall 17 shown in FIG. 5 that regulate the air flow through accurate flow restricting openings 20.

The exterior overlapping end wall 16 has at least one slotted heat shield fastener opening 21 likewise to accommodate the accumulation of minor alignment tolerances in assembly with the smaller circular openings 21 shown in FIG. 5 that hold the threaded stud fasteners 15 of the heat shields 14.

Therefore the invention provides slotted or oversized openings 20, 21 in the externally overlapping end wall 16 in alignment with smaller holes 20, 21 in the internally overlapping end wall 17 to accommodate manufacturing and alignment tolerances in assembly, while maintaining the sealing surface integrity of the overlapping end walls 16, 17 clamped and sealed together with the fasteners 15. The size of the slotted or oversized impingement air openings 20 shown in FIG. 4 must be large enough to account for stack up allowances between the combustor components so that the impingement air openings 20 shown in FIG. 5 are not obstructed. However the size of the larger openings should not be so large as to jeopardize the overlapping sealing surface between the end walls 16, 17 and create a disruption in sealing between the hot combustor gases inside the combustor 8 and the compressed air outside the combustor 8 in the plenum 7. The size should also not be so large as to negatively affect the structural integrity or rigidity of the combustor end wall.

The above description is meant to be exemplary only, and one skilled in the art will recognize that changes may be made to the embodiments described without department from the scope of the invention disclosed. For example, the overlapping portion need not be present in a combustor end wall, but in any portion of the combustor. The combustor liners may be fastened using any suitable means, and need not be fastened by heat shields. Heat shields need not be present at all. Still other changes will be apparent to the skilled reader. Although the above description relates to specific preferred embodiments as presently contemplated by the inventors, it will be understood that the invention in its broad aspect includes mechanical and functional equivalents of the elements described herein.

We claim:

1. A combustor for a gas turbine engine comprising an inner combustor wall terminating in an inner end wall portion and an outer combustor wall terminating in an outer end wall portion, wherein the inner and outer end wall portions at least partially overlap each other defining a combustor end wall including an exterior overlapping end portion and an interior overlapping end portion, each overlapping end portion having a plurality of impingement air openings, wherein the exterior overlapping end portion has at least one of said openings having a larger dimension than an aligned opening in the interior overlapping end portion defining an aligned pair of impingement air openings.

2. A combustor according to claim 1, wherein said larger dimension is selected to include a tolerance stack-up dimension.

3. A combustor according to claim 1, wherein the exterior overlapping portion has at least one slotted impingement air opening.

4. A combustor according to claim 1 wherein the exterior overlapping end portion has at least one slotted heat shield fastener opening.

5. A combustor according to claim 1 wherein a heat shield assembly is mounted internally to the combustor, and the aligned pair of impingement air openings are adapted to cool the heat shield by directing impingement air at an underside surface of the heat shield.

6. A combustor according to claim 5 wherein the heat shield includes inner and outer connectors that join the heat shield to the end wall portion of the inner combustor wall and to the end wall portion of the outer combustor wall.

* * * * *